US008230697B2

(12) United States Patent
Lavallee

(10) Patent No.: US 8,230,697 B2
(45) Date of Patent: Jul. 31, 2012

(54) COOLER AND COOLER ACCESSORY WITH INTEGRATED LIQUID DISPENSER

(76) Inventor: Paul Lavallee, Calgary (CA)

( * ) Notice: Subject to any disclaimer, the term of this patent is extended or adjusted under 35 U.S.C. 154(b) by 656 days.

(21) Appl. No.: 12/403,403

(22) Filed: Mar. 13, 2009

(65) Prior Publication Data

US 2009/0320517 A1 Dec. 31, 2009

Related U.S. Application Data

(63) Continuation-in-part of application No. 11/745,366, filed on May 7, 2007.

(30) Foreign Application Priority Data

Mar. 10, 2009 (CA) ..... 2657663

(51) Int. Cl.
*F25D 3/00* (2006.01)

(52) U.S. Cl. ..... 62/457.7

(58) Field of Classification Search ..... 62/457.1, 62/457.2, 457.5, 457.7, 371
See application file for complete search history.

(56) References Cited

U.S. PATENT DOCUMENTS

| | | | | |
|---|---|---|---|---|
| 3,395,550 | A * | 8/1968 | Dungan | 62/400 |
| 4,653,290 | A | 3/1987 | Byrne | |
| 4,974,426 | A * | 12/1990 | Gomez et al. | 62/457.7 |
| 5,165,583 | A * | 11/1992 | Kouwenberg | 224/148.3 |
| 5,924,303 | A * | 7/1999 | Hodosh | 62/457.4 |
| 6,067,816 | A * | 5/2000 | Hodosh | 62/457.4 |
| 6,425,498 | B1 | 7/2002 | Gheorgheos | |
| 6,446,461 | B1 | 9/2002 | Williams, Jr. | |
| 6,851,276 | B2 * | 2/2005 | Perrins | 62/457.5 |
| 6,935,533 | B2 * | 8/2005 | Clausen et al. | 222/143 |
| 7,861,552 | B1 * | 1/2011 | Hughes | 62/457.2 |
| 2006/0053826 | A1 | 3/2006 | Drabkin | |
| 2006/0201966 | A1 | 9/2006 | Macler et al. | |

* cited by examiner

*Primary Examiner* — Melvin Jones
(74) *Attorney, Agent, or Firm* — Laurence P. Colton; Smith Risley Tempel Santos LLC

(57) ABSTRACT

A cooler comprising a container body having an exterior surface and at least a partially hollow interior. The container body has one or more receptacles formed within its exterior surface and extending into the hollow interior. The receptacles have enclosed bottom and side surfaces and open tops. The hollow interior of the container body is sealed and provides a fluid-tight reservoir to hold a fluid or a frozen or partially frozen fluid or gel. The container further contains a dispenser to permit the controlled release of fluid stored in the interior of the container.

14 Claims, 12 Drawing Sheets

COOLER AND COOLER ACCESSORY WITH INTEGRATED LIQUID DISPENSER

STATEMENT OF RELATED APPLICATIONS

This patent application is a continuation-in-part of (i) U.S. patent application Ser. No. 11/745,366, having a filing date of 7 May 2007, currently pending, and (ii) Canadian Patent Application No. 2657663 having a filing date of 10 Mar. 2009, currently pending, the contents of which are each incorporated herein by reference in their entireties.

BACKGROUND OF THE INVENTION

1. Field of the Invention

This invention relates generally to portable coolers and cooler accessories of the type that may be used to maintain the temperature of foods and beverages and other items, and in one specific embodiment a portable cooler or cooler accessory having an integrated liquid dispenser.

2. Prior Art

Portable coolers are typically used by individuals for a wide variety of purposes in order to maintain the temperature of foods, beverages and other items when transporting them from location to location. Traditionally portable coolers have been comprised of a hard or rigid outer shell and an inner liner with an insulating material therebetween. Such coolers are often fitted with a handle or a strap to allow them to be readily carried from place to place and may have a single, hinged, lid or a plurality of lid openings to allow access into the cooler interior. More recently the manner of construction of portable coolers has expanded and many coolers are now formed with an outer and inner shell made from a flexible or woven material, such as nylon, that allows the coolers to be collapsed when not in use. Most often portable coolers are insulated using a relatively high density foam insulating material.

When utilizing currently available portable coolers individuals will typically fill the coolers full of food, beverages or other items and place ice cubes, blocks of ice, frozen gel packs, chilled liquid, etc. within the cooler in order to help keep the contents cold for an extended length of time. In other cases heated items may be placed in a cooler to help maintain its contents at an elevated level.

Coolers are often fitted with a drain spout or sealable opening at or near their bottom edge to allow for water that accumulates from the melting of ice cubes or blocks of ice to be drained and discarded. Unfortunately, water that results from the melting of ice used to keep the contents of the cooler cold is not always fit for human consumption as it will have been in full contact with the interior surface of the cooler and the outer surfaces items stored therein. Maintaining cold or chilled water within a cooler thus requires the use of a dedicated bottle or vessel to keep the water contained and to avoid contamination through contact with unsanitary surfaces. Unfortunately, such dedicated containers are often in the form of bottles or similarly shaped vessels that do not always lend themselves to close or efficient packing within the interior of a cooler, where space is usually of a premium. Further, in instances where vessels of water or fluid are first frozen before placing them into the cooler, they may help to assist in maintaining the contents of the cooler at a desired temperature but generally do not allow for close proximity contact with individual beverages, food items, or other items stored in the cooler. As a result, frozen vessels of water or fluid within the cooler tend to create localized cold zones that may keep adjacent food or beverages cool but not necessarily cold. There therefore exists a need for a new and improved cooler or cooler accessory that helps to keep food, beverages and other items cold or at or near a desired temperature while also serving as a source and dispenser of water or other liquid.

BRIEF SUMMARY OF THE INVENTION

The invention therefore provides a cooler or cooler accessory that may be used to help keep beverages, food or other items at or near a desired temperature while at the same time serving as both a reservoir and a dispensary for water or liquid.

Accordingly, in one of its aspects the invention provides a cooler comprising a container body having an exterior surface and at least a partially hollow interior, said container body having one or more receptacles formed within said exterior surface and extending into said hollow interior, said receptacles having enclosed bottom and side surfaces and open tops, said hollow interior of said container body sealed and providing a fluid-tight reservoir to hold a fluid or a frozen or partially frozen fluid or gel, said container further containing a dispenser to permit the controlled release of fluid stored in said interior of said container.

In a further aspect the invention provides a cooler comprising a container body having an upper body portion and a lower body portion and at least a partially hollow interior, said upper body portion having one or more receptacles formed within its exterior surface, said receptacles having enclosed bottom and side surfaces and open tops, said hollow interior of said container body sealed and providing a fluid-tight reservoir to hold a fluid or a frozen or partially frozen fluid or gel, said container further including a dispenser to permit the controlled release of fluid stored in said interior of said container body such that when said hollow interior of said container body is filled or partially filed with water or fluid and thereafter frozen or chilled said frozen or chilled water or fluid helps maintain items positioned within said receptacles cool with said dispenser providing a source of cold or chilled water or fluid.

The invention also provides a cooler comprising a container body formed generally from an upper and a lower body portion, said container body having at least a partially hollow interior and having one or more receptacles formed in the exterior surface of said upper body portion and extending into said hollow interior, said one or more receptacles having enclosed bottom and side surfaces and open tops said hollow interior of said container providing a fluid-tight reservoir to hold a fluid or frozen or partially frozen fluid or gel, said container further including a dispenser to permit the controlled release of fluid from said interior of said container, said container body having an expansion zone allowing for the expansion of said container body upon the freezing or expansion of water or liquid stored in said hollow interior.

In still a further embodiment the invention provides a cooler comprising a container body formed generally from a first and a second body portion, at least one of said first and second body portions having at least a partially hollow interior and a dispenser, at least one of said body portions having one or more receptacles formed in their exterior surfaces, said one or more receptacles having enclosed bottom and side surfaces and open tops, said at least partially hollow interior providing a fluid-tight reservoir to hold a fluid, said dispenser permitting the controlled release of fluid from said at least partially hollow interior, said first and second body portions releasably securable together such that said one or more receptacles create an enclosed cavity between said body portions to accommodate and receive articles therein for the purpose of helping to maintain said articles at a desired temperature.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention which.

DETAILED DESCRIPTION OF PREFERRED EMBODIMENTS

Figure 1:
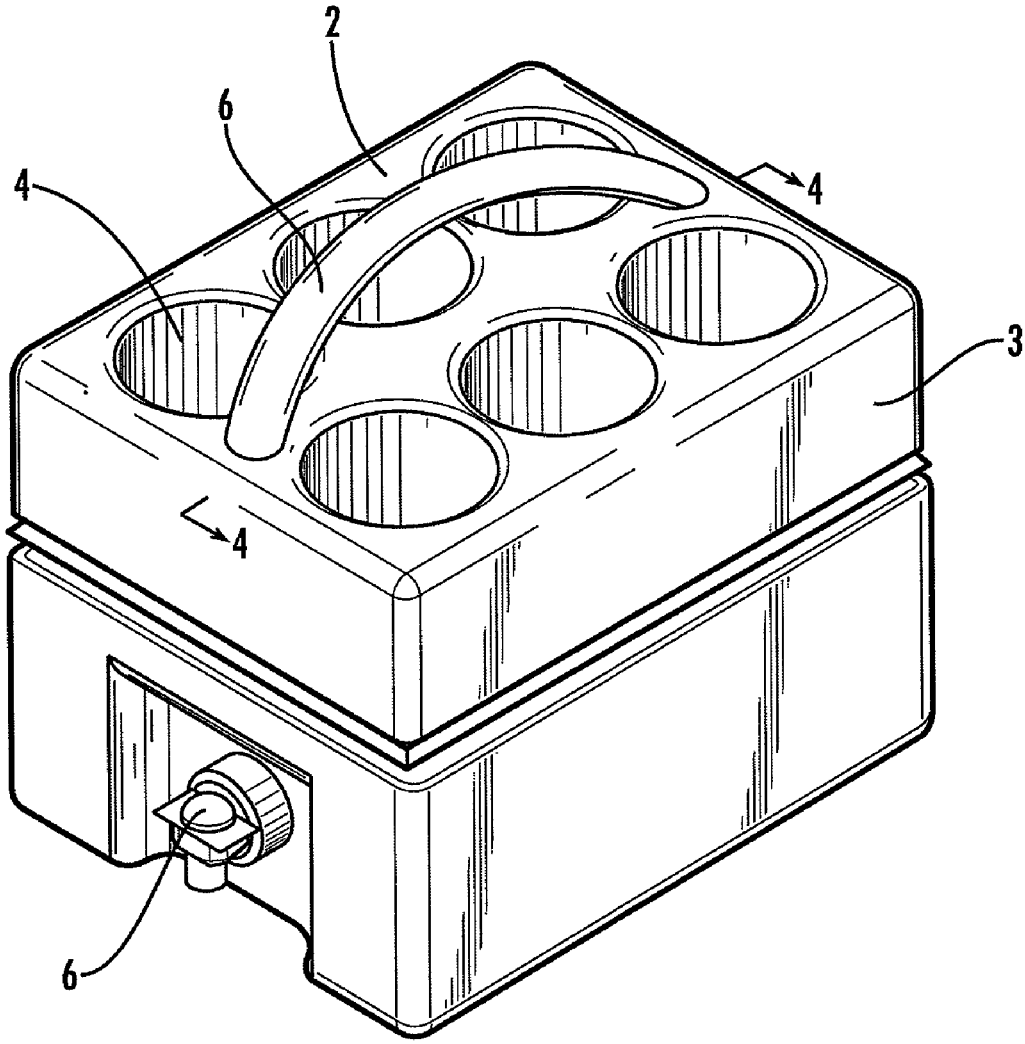
FIG. 1 is an upper front perspective view of a cooler or cooler accessory constructed in accordance with one of the preferred embodiments of the present invention.
Figure 2:
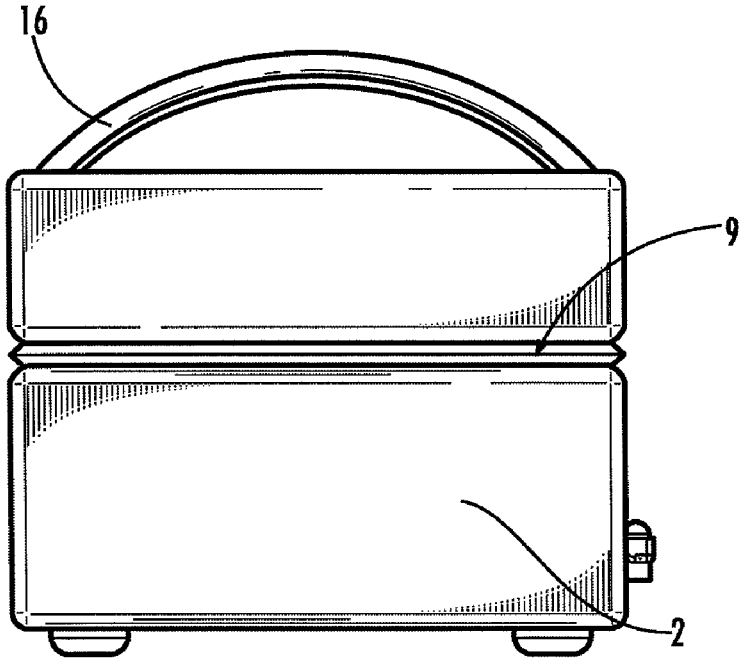
FIG. 2 is a side elevational view of the device shown in FIG. 1.
Figure 3:
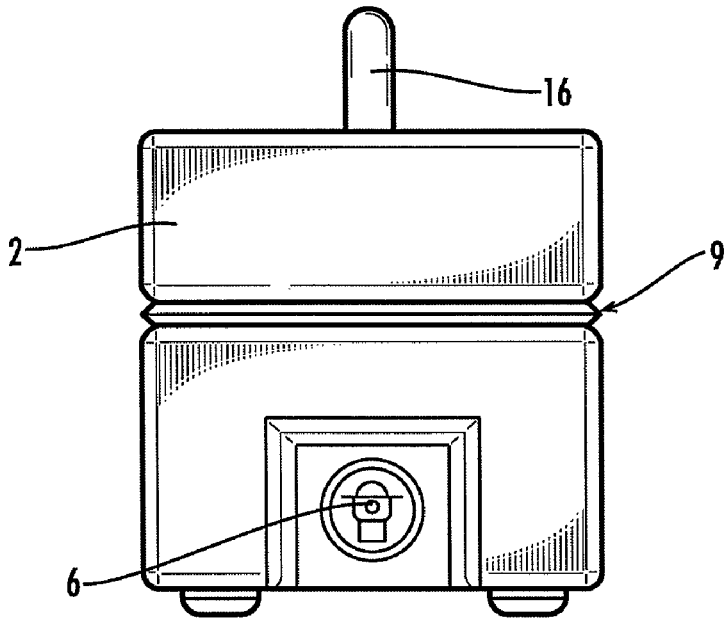
FIG. 3 is a left end view of the device shown in FIG. 1.

The present invention may be embodied in a number of different forms. However, the specification and drawings that follow describe and disclose only some of the specific forms of the invention and are not intended to limit the scope of the invention as defined in the claims that follow herein.

In the attached drawings the cooler or cooler accessory constructed in accordance with one of the preferred embodiments of the present invention is noted generally by reference numeral 1. As will be appreciated after a thorough understanding of the invention, device 1 could be referred to as either a cooler or a cooler accessory since it may be used by itself or it may be placed within a larger cooler.

With reference to FIGS. 1 through 4, cooler 1 is comprised generally of a container body 2 having an exterior surface 3 with one or more receptacles 4 formed therein. Container body 2 has at least a partially hollow interior 5 such that receptacles 4 within the exterior surface 3 of the container body extend into the partially hollow interior. Receptacles 4 preferably have enclosed bottom and side surfaces with open tops and may be dimensioned to accommodate the receipt of a wide variety of different items, which may include food or beverage containers, or for that matter any other item which is desired to be kept at a depressed or elevated temperature. In the embodiment shown in FIGS. 1 through 4, receptacles 4 are generally cylindrical in shape in order to accommodate bottles or other beverage containers. It will also be noted that the dimensions of container body 2 could be varied, and the number of individual receptacles adjusted, to accommodate particular needs or desires.

In one preferred embodiment of the invention the hollow interior 5 of container body 2 is sealed to provide a fluid-tight reservoir that is capable of holding a fluid or a frozen or a partially frozen fluid or gel. Container body 2 also preferably includes a dispenser 6 within its exterior surface that in one embodiment of the invention permits both the introduction and the controlled release of fluid from the interior of the container body. In an alternate embodiment of the invention body 2 may include a separate filler opening through which fluid may be introduced into the interior of the container body. Dispenser 6 will typically be located toward the bottom of one of the side surfaces of container body 2 to allow for liquid within hollow interior 5 to be readily drained therefrom. It is expected that in most instances dispenser 6 will be in the form of a spigot or a valve, however, in alternate embodiments of the invention the dispenser may be releasably sealed through the use of a threaded cap, a threaded or expansion plug, or other sealing device. In a further alternate embodiment of the invention (not shown), liquid within hollow interior 5 may be held and retained in a dedicated flexible bladder connected to dispenser 6.

In order to help reduce heat transfer between the ambient environment and hollow interior 5 of container body 2, in one embodiment of the invention the interior surface 7 of the container body is lined with a layer of insulation 8, which may be comprised of a high density foam or variety of other commonly used insulating materials. In an alternate embodiment of the invention the container body may be comprised of an inner and an outer shell having an insulating or foam layer therebetween, as is common with many portable coolers. In yet a further embodiment, the container body may be constructed without the use of dedicated insulation material.

In the form of the invention shown in FIGS. 1 through 4 expansion zone 9 is incorporated into container body 2 to allow for the expansion of water or liquid stored in hollow interior 5 when it is subjected to freezing temperatures. Expansion zone 9 permits the container body to expand and helps to prevent cracking or breakage as its contents expand when frozen. Expansion zone 9 may be comprised of a plurality of pleats extending around the container body forming an accordion-like structure that allows for the container body to expand in a controlled manner at a pre-determined location. However, it will also be appreciated that any one of a wide variety of other expansion mechanisms may be used in the place of or in addition to the pleats of expansion zone 9 that were shown in the attached figures.

Figure 4:
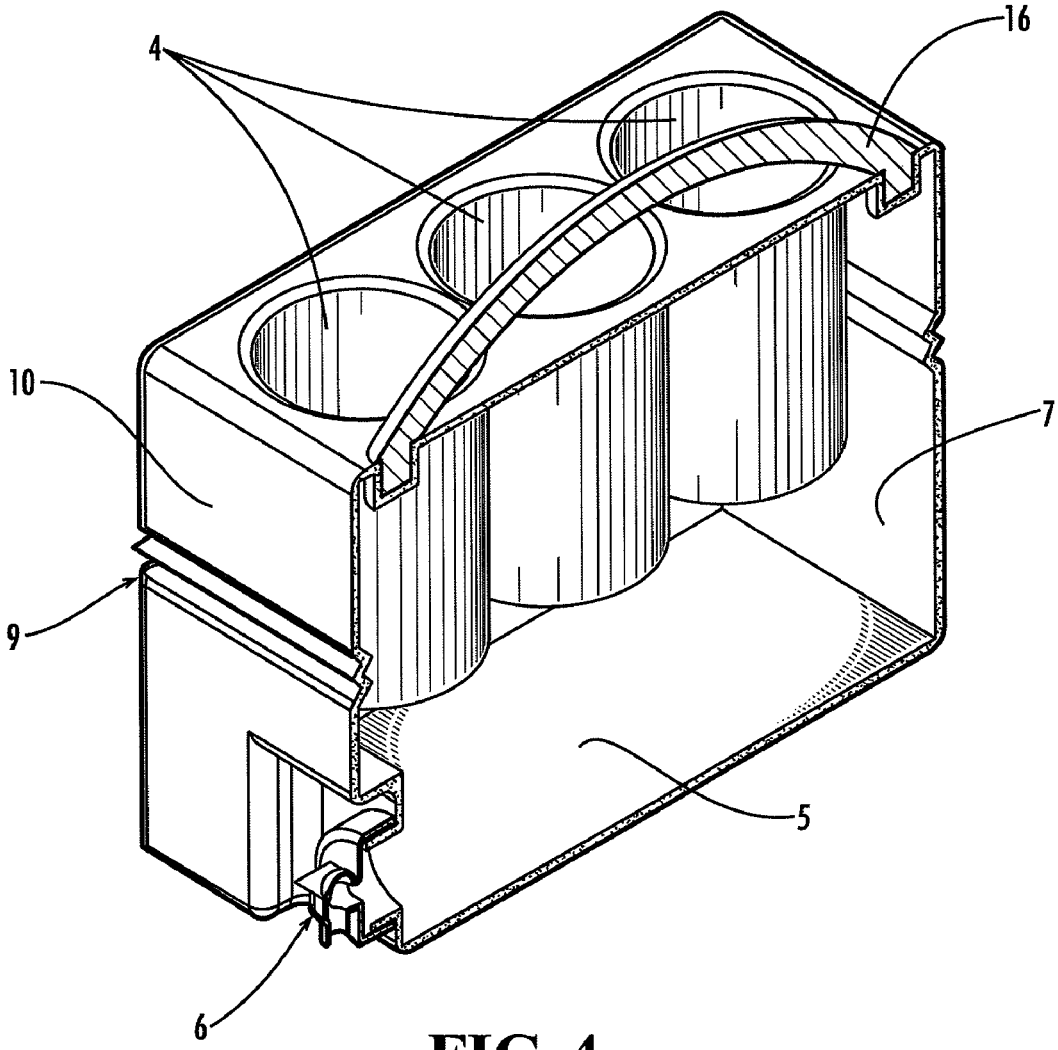
FIG. 4 is a longitudinal sectional view taken along the line 4-4 of FIG. 1.
Figure 5:
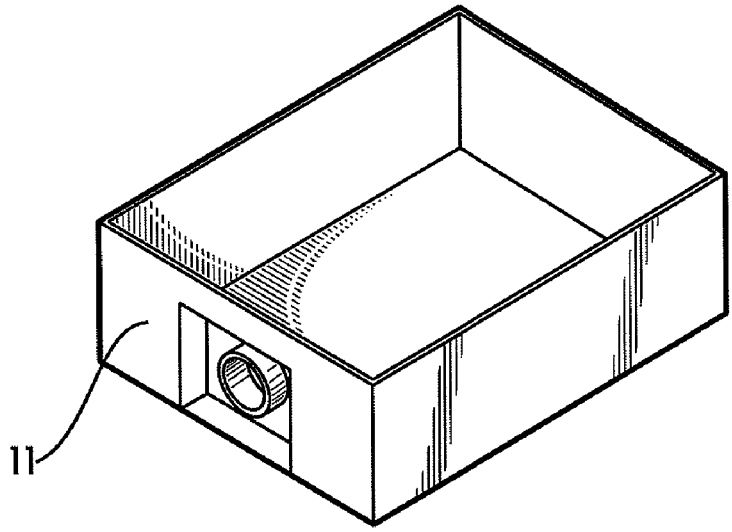
FIG. 5 is an upper side perspective view of the bottom half of a cooler or cooler accessory constructed in accordance with an alternate embodiment of the invention.
Figure 6:
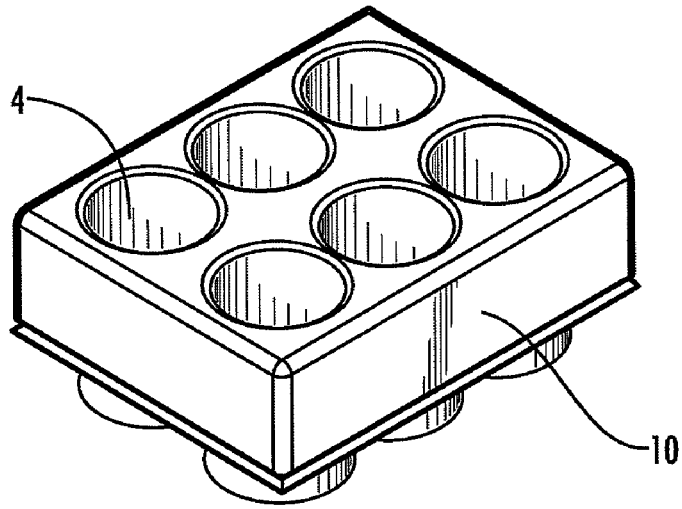
FIG. 6 is an upper side perspective view of the upper portion of the cooler or cooler accessory shown in FIG. 5.
Figure 7:
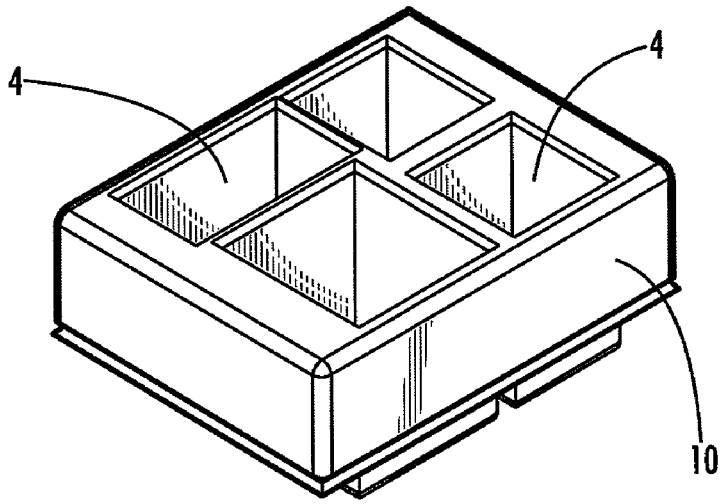
FIG. 7 is an upper side perspective view of an alternate embodiment of the upper portion of the cooler or cooler accessory shown in FIG. 6.

In one version of the invention, container body 2 is formed from an upper body portion 10 and a lower body portion 11, wherein the upper body portion contains receptacles 4 and the lower body portion contains dispenser 6. In the embodiment shown in FIGS. 1 through 4, the upper and lower body portions are generally separated by expansion zone 9, however the expansion zone may also be located at other points within the container body and not necessarily at the juncture of the upper and lower body portions. Depending upon the method of manufacture, the upper and lower body portions could be formed in one piece such that they create a unitary structure. Alternatively, the upper and lower body portions may be manufactured separately and secured and sealed together by a wide variety of different means, including through the use of mechanical seals, heat welding, glues, epoxies, etc. In FIG. 4 the upper and lower body portions are formed as two separate parts and made from a plastic or similar material that is sealed together along expansion zone 9 by means of heat welding to create a fluid tight and sealed hollow interior 5. FIGS. 5, 6 and 7 show alternate embodiments of upper body 10 and lower body 11 formed as distinct and separate units that are subsequently sealed together to form container body 2. In the case of the embodiment of upper body portion 10 shown in FIG. 7, receptacles 4 are depicted as being generally rectangular in shape to demonstrate that the physical configuration of the receptacles may be altered to permit the receipt of different types and shapes of items therein.

Figure 8:
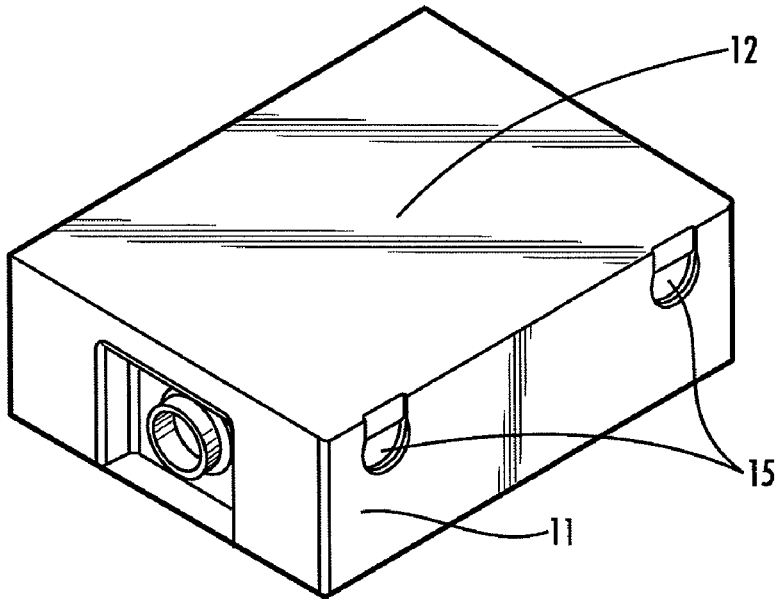
FIG. 8 is an upper side perspective view of the lower portion of a cooler or cooler accessory in accordance with yet a further embodiment of the present invention.
Figure 9:
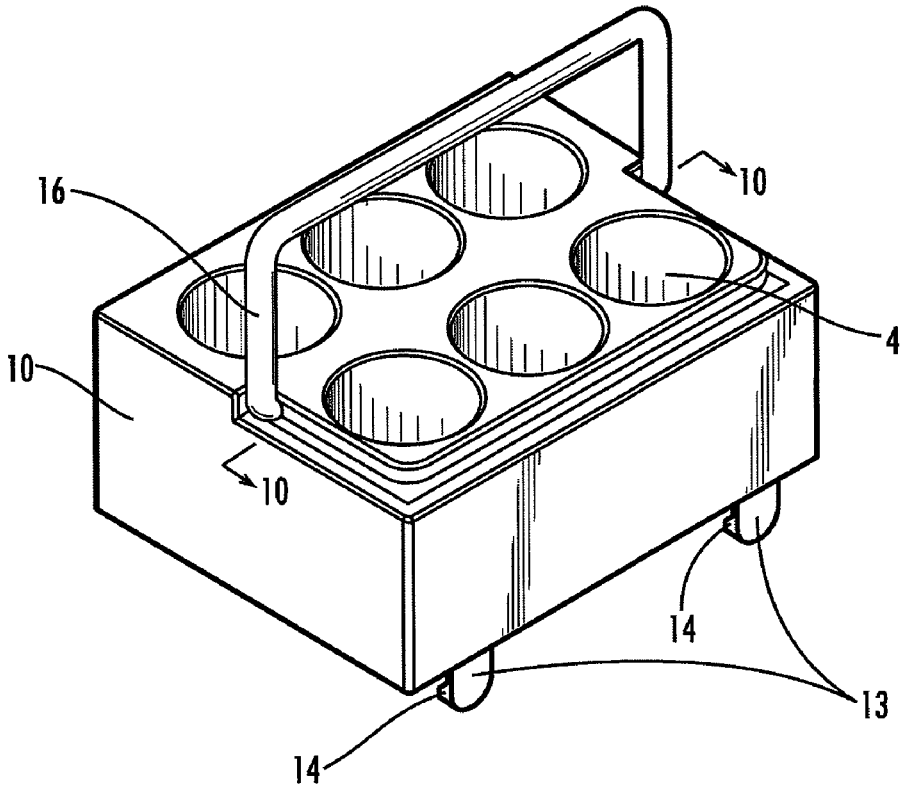
FIG. 9 is an upper side perspective view of the upper portion of the cooler or cooler accessory shown in FIG. 8.
Figure 10:
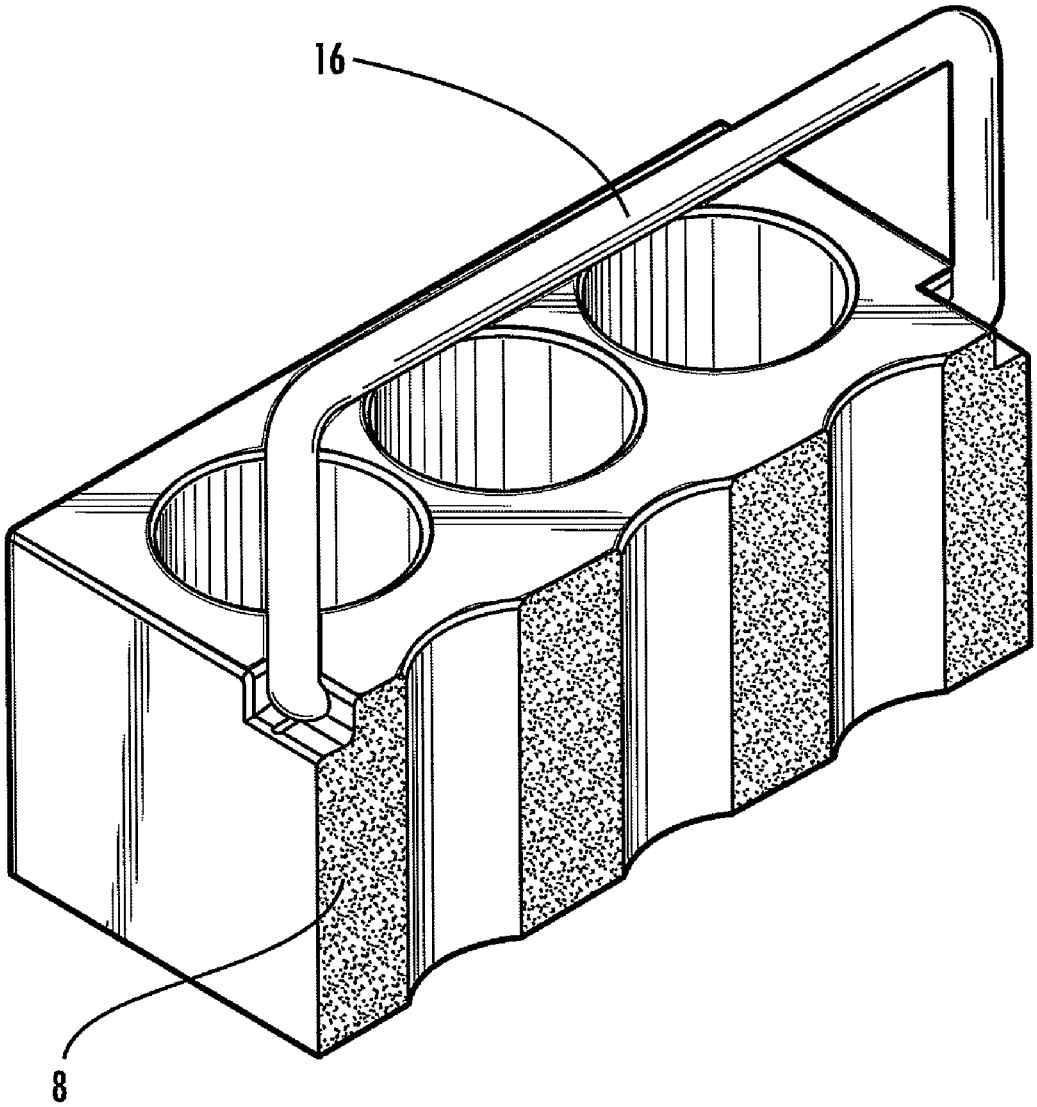
FIG. 10 is a sectional view taken along the line 10-10 in FIG. 9.
Figure 11:
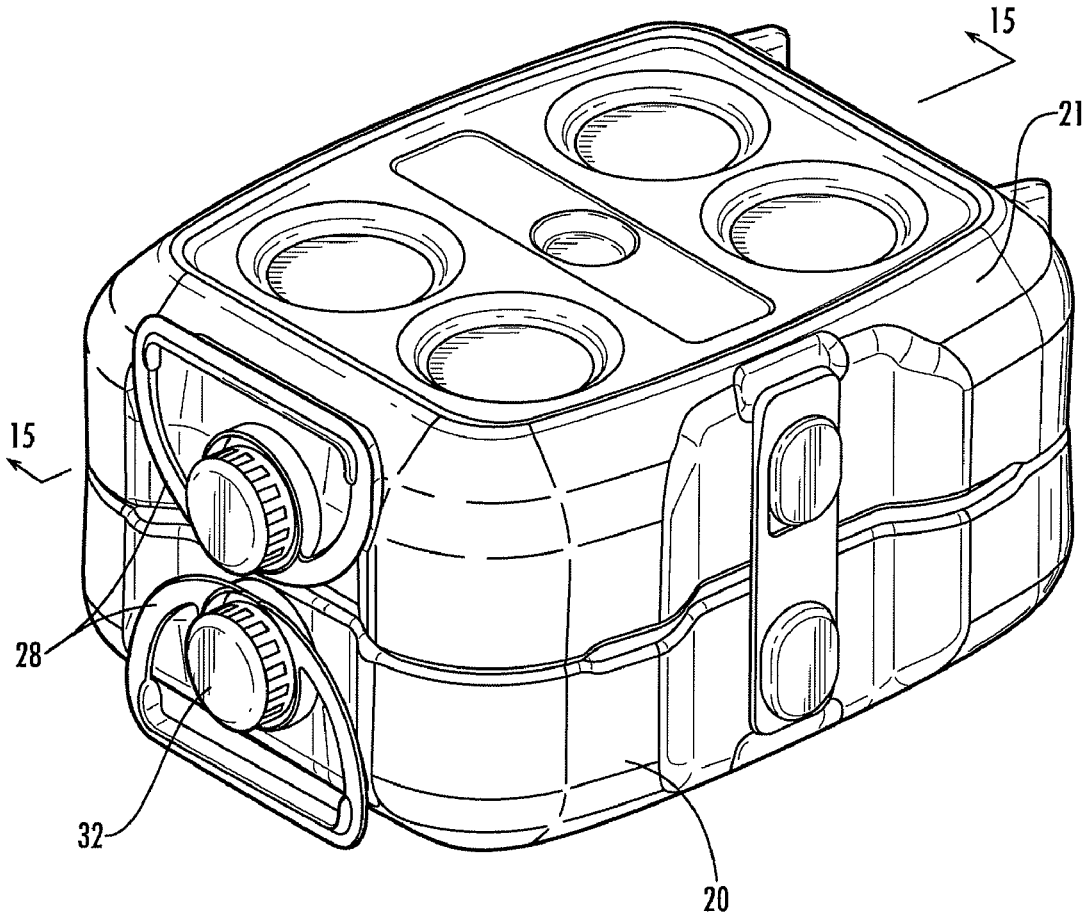
FIG. 11 is a side perspective view of an alternate embodiment of a cooler constructed in accordance with one of the preferred embodiments of the present invention.

A further alternate embodiment of the invention is shown in FIGS. 8, 9 and 10. Here, upper and lower body portions 10 and 11 are manufactured independently from one another, and lower body portion 11 includes a sealed cover 12 that completely encloses the upper surface of the lower body portion such that the lower body portion forms a fluid tight reservoir. It is expected that in most instances cover 12 will be of unitary construction with the remainder of the lower body portion. In other instances the cover may be formed separately and secured to the lower body portion through a variety of different means which include mechanical seals, heat welding, gluing, epoxying, etc.

Figure 12:
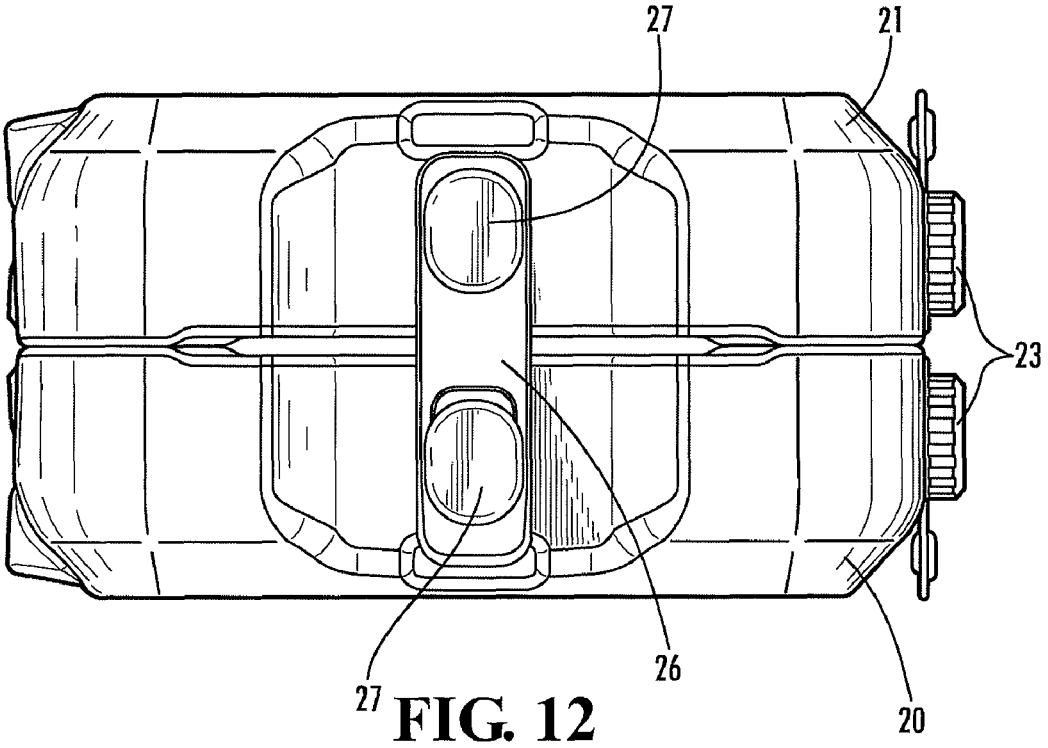
FIG. 12 is a side elevational view of the embodiment of the cooler shown in FIG. 11.
Figure 13:
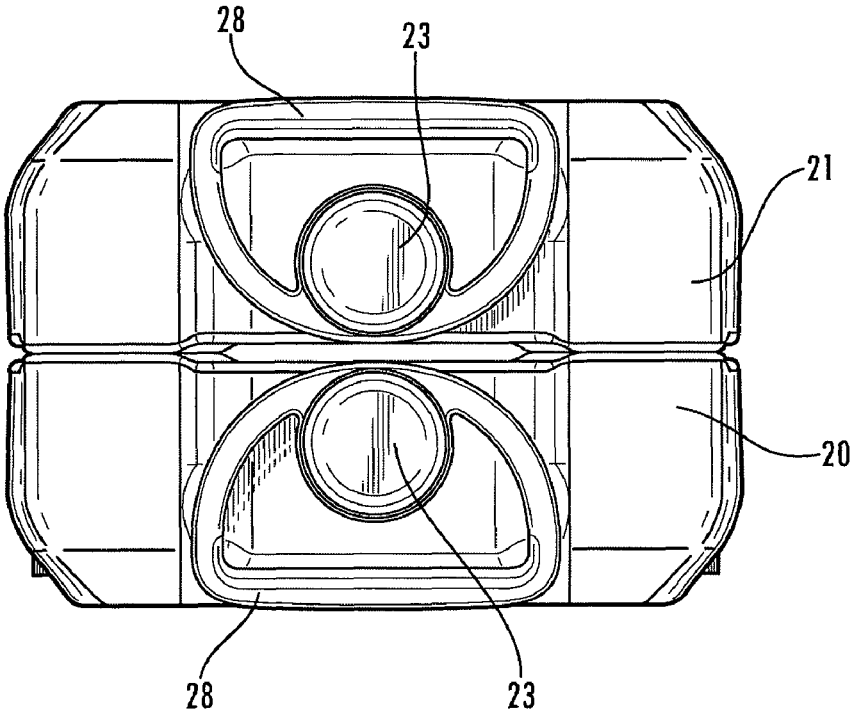
FIG. 13 is a top plan view of the cooler shown in FIG. 11.

It will also be noted from an examination of FIG. 8 that in this embodiment the upper and lower body portions 10 and 11 are releasably securable to one another to permit their independent use, and to also permit the interchangeability of upper body portions having alternately sized or alternately configured receptacles for different end uses. For illustration purposes, the receptacles in upper body portion 11 shown in FIG. 12 are generally cylindrical and arranged in a 2 by 3 matrix. Once again, it will be appreciated by those skilled in the art that many different structures may be employed to releasably secure the upper and lower body portions together in this embodiment of the invention. In FIGS. 8 and 9 the securement mechanism comprises a series of flexibly resilient tabs 13 having outwardly extending shoulders 14 that are received in correspondingly shaped indentations 15 on the exterior surface of lower body portion 11 to releasably secure the upper and lower body portions together.

Container body 2 may also include a handle 16 to aid in carrying it from place to place. It is expected that in most instances handle 16 would be secured to upper body portion 10. In the embodiment of the invention shown in FIGS. 1 through 4 the handle is rigidly secured to the upper surface of upper body portion 10, whereas in FIGS. 9 and 10 the handle 16 is rotatably mounted to the upper body portion so that it may be stowed in a horizontal position.

Finally, in the embodiment of the invention shown in FIG. 10, the interior of upper body portion 10 is filled or partially filed with insulating material 8. Alternately, the interior of the upper body portion may be filled or partially filled with a gel or other thermal material having heat or cold retaining characteristics such that the thermal material assists in keeping items placed within receptacles 4 either hot or cold, as the case may be. Where the intent is to keep items placed in the receptacles cold, the thermal material may be comprised of gel packs such as those that are commonly used in portable coolers.

From a thorough understanding of the invention it will be appreciated that cooler 1 provides the means to help maintain items that may be received or placed within receptacles 4 at or near a desired temperature. While cooler 1 could be used to maintain items at an elevated temperature (for example by placing hot water within hollow interior 5), it is expected that in most instances the cooler will be used to help keep particular articles or items cold, or to chill items placed within the receptacles on its upper surface. Prior to use it is expected that the hollow interior of the container body will be at least partially filled with water or other liquid with the container body (or the lower body portion in the event that the container body is formed in two parts) then placed in a cold environment, a refrigerator or a freezer in order to freeze or chill the liquid stored therein. Thereafter, the chilled or frozen liquid will provide a means to chill items received within receptacle 4 and/or to help maintain such items at a depressed temperature. Where the liquid received within container body 2 is water, the hollow interior of the container body will provide a reservoir for potable chilled water that may be used for drinking, cooking or washing purposes. Cooler 1 may be used by itself and transported from place to place by means of handle 16. Where desired the cooler may also be placed within the interior of a larger cooler or storage device where the chilled or frozen water or fluid within hollow interior 5 can be used to help keep other fluids, beverages or articles cold.

FIGS. 11 through 17 show an alternate embodiment of the invention where the cooler is formed generally from a first body portion 20 and a second body portion 21. At least one of body portions 20 and 21 preferably have one or more receptacles 25, having enclosed bottom and side surfaces and open tops, formed in their exterior surfaces. As shown in FIGS. 11 through 17 in this embodiment of the invention the first and second body portions are releasably securable together such that the receptacle or receptacles are contained within the interior of the assembled cooler. As shown, at least one of the first and second body portions, 20 and 21 respectively, have at least a partial hollow interior 22 and a dispenser 23. The at least partial hollow interiors provide a fluid-tight reservoir to hold a fluid, or alternately a frozen or partially frozen or fluid or gel. The dispenser, which may be in the form of a cap 32 as shown in FIG. 1 or a spigot 24 shown in FIG. 17, serves as a means to fill or partially fill hollow interior 22 with fluid or gel and also serves as a means to allow fluid or gel to be extracted from the hollow interior of the respective body portion.

Figure 14:
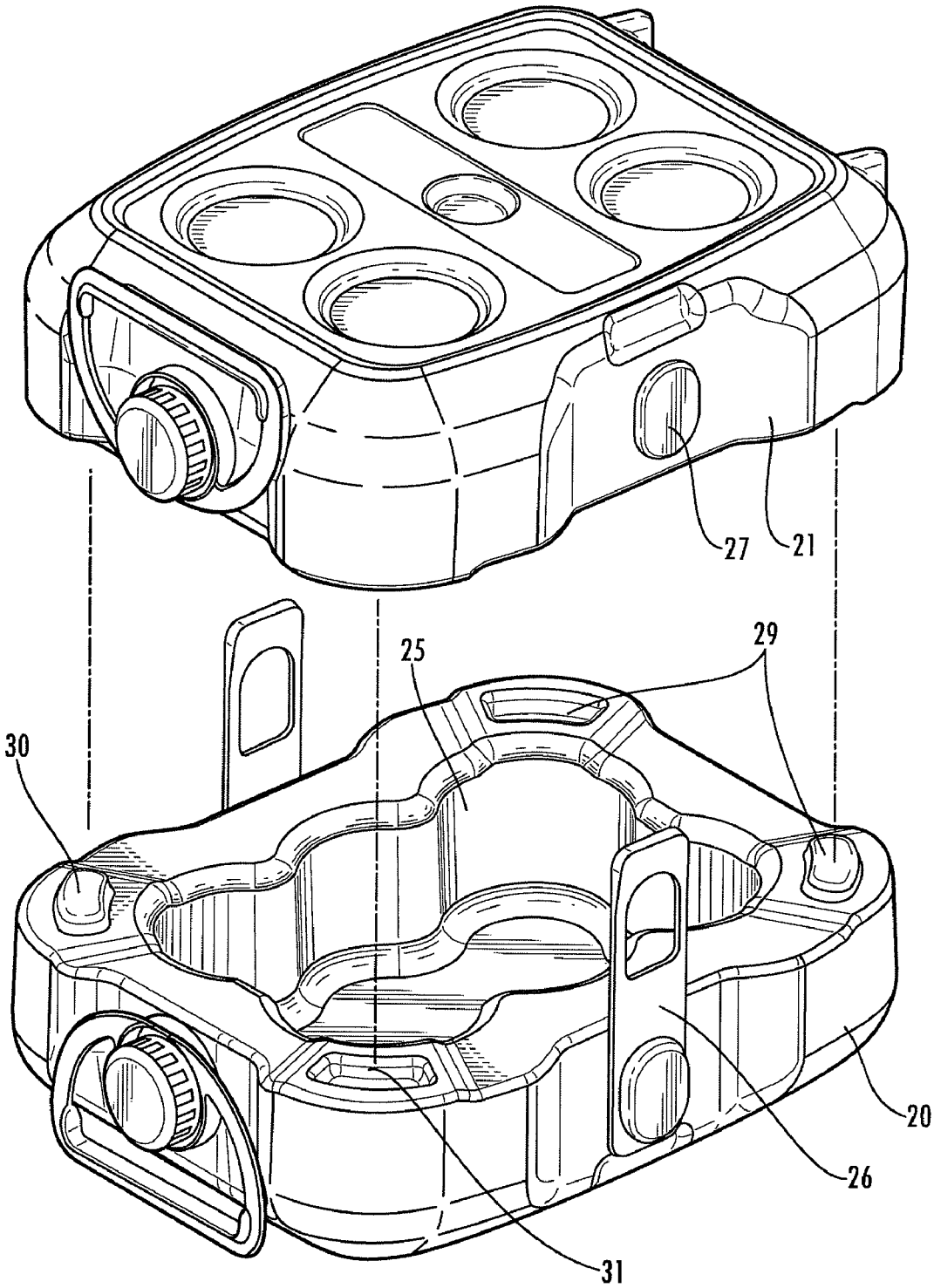
FIG. 14 is an exploded view of the cooler shown in FIG. 11.
Figure 15:
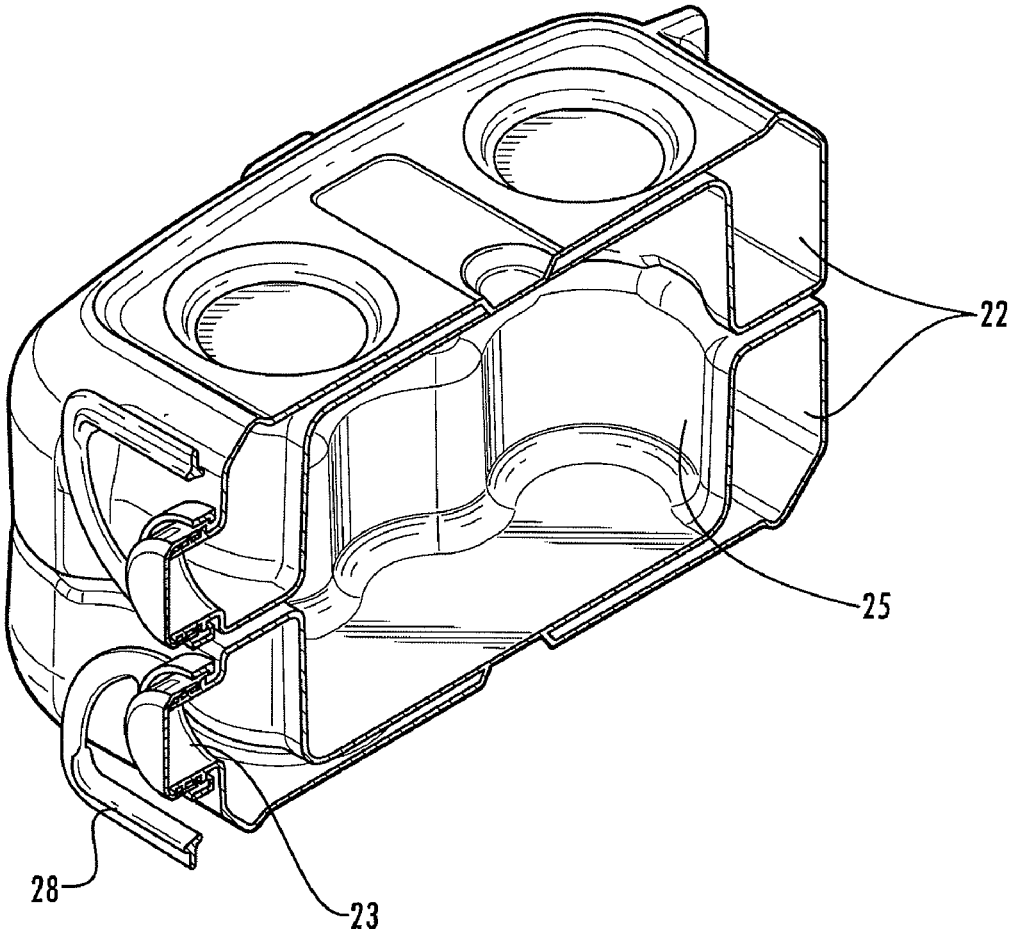
FIG. 15 is a vertical sectional view taken all along the line 15-15 in FIG. 11.
Figure 16:
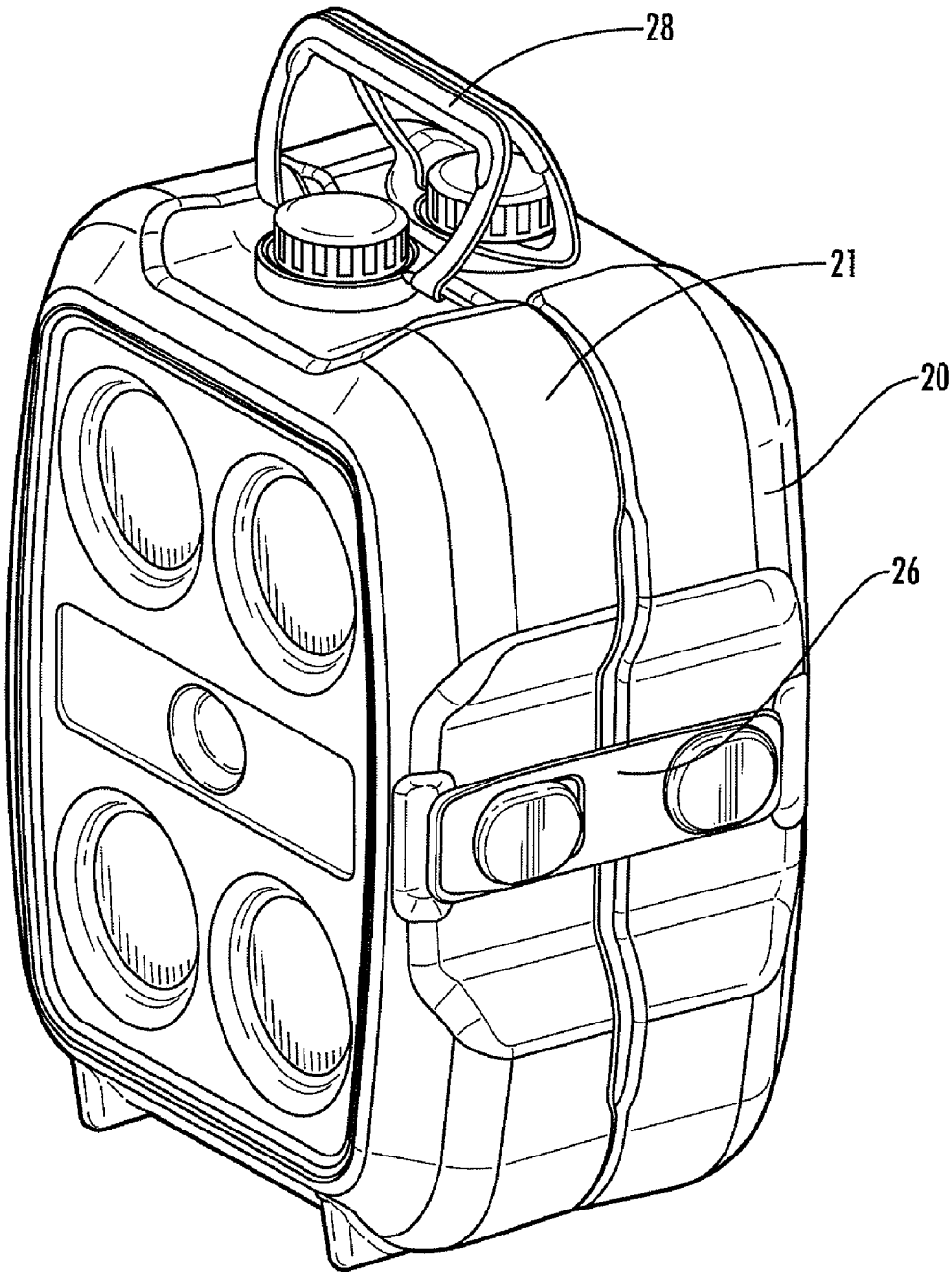
FIG. 16 is a side perspective view of the cooler shown in FIG. 11 with its handles in an upright configuration.
Figure 17:
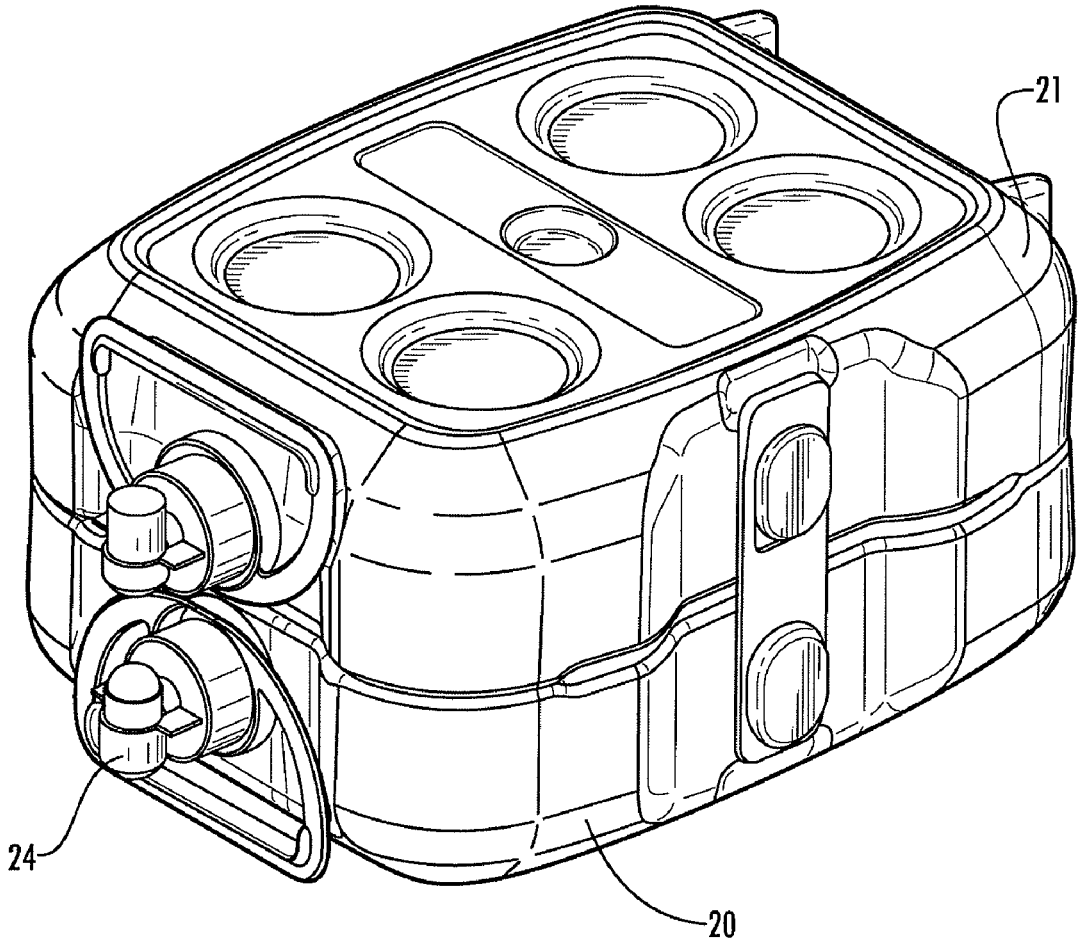
FIG. 17 is a further embodiment of the cooler shown in FIG. 11.

As in the case of the prior embodiment described above, in one application of the invention it is anticipated that the fluid in question will be water or other potable liquid that can be frozen to help maintain the temperature of articles placed in the one or more receptacles 25 such that the water or other fluid can be drained or extracted from the hollow interior of the body portion for consuming or other purposes when desired. Referring specifically to FIGS. 14 and 15, it will be appreciated that receptacles 25 in the first and second body portions are configured in such a fashion that when the body portions are releasably secured together the receptacles generally align with each other forming an enclosed cavity to accommodate and receive articles therein for the purpose of helping to maintain the articles at a desired temperature, whether that be an elevated or a depressed temperature. In addition, the shape and configuration of the receptacles can vary depending upon the desire and use of the cooler. For example, where there is a desire to maintain cans containing soda, brewed beverages, alcoholic beverages, etc. at a particular temperature, receptacles 25 can be configured to closely receive a particular number of cans and hold them in a secure manner to prevent excessive relative movement between them.

It will further be appreciated that in the embodiment in the invention shown in FIGS. 11 through 17 the first and second body portions may be releasably secured together through the use of a wide variety of different clamping, clasping or securing means or members. In the particular embodiment shown the body portions are held together through the use of elastomeric latches 26 that are received about posts 27 on the body portions. It will also be noted from the attached figures that the first and second body portions may include handles 28 to assist in carrying and transporting the cooler. In the particular embodiment shown handles 28 may have a retracted position (see FIG. 1) and an extended position (see FIG. 16).

It is to be further noted that although in the attached drawings both of the first and second body portions have at least a partially hollow interior, it is equally possible to design the cooler such that only one of the body portions has at least a partial hollow interior with the other body portion being solid or semi-solid. Similarly, either or both of the body portions may have one or more receptacles 25 formed in their exterior surfaces.

Referring again to FIGS. 14 and 15, in one of the preferred embodiments first and second body portions 20 and 21 include co-operating members 29 that assist in maintaining the first and second body portions in an aligned configuration when they are releasably secured together. Once again it should be appreciated that co-operating members 29 can take any one of a wide variety of different configurations and structures. In the embodiment shown in FIGS. 14 and 15 the co-operating members comprise a raised post portion 30 that is received within a correspondingly shaped indentation 31 in the opposite body portion when the two body portions are secured together.

As in the case of the embodiment of the invention shown in FIGS. 1 through 10, the embodiment of the invention shown in FIGS. 11 through 17 provides the means to help maintain items or articles that may be received or placed within the receptacles at or near a desired temperature. In the instance of the embodiment shown in FIGS. 11 through 17 the articles are securely received between the two body portions which are releasably secured together. The cooler in this embodiment may be used by itself and transported from place to place by means of handle 28 or, where desired, it may be placed within the interior of a larger cooler or storage device where the chilled or frozen water or fluid within the hollow interior of the body portions can be used to help keep other fluids, beverages or articles cold.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A cooler comprising a container body comprised of an upper and a lower body portion, each of said body portions having an exterior surface and at least a partially hollow interior, said upper body portion having at least one receptacle formed within said exterior surface and extending into said hollow interior, said at least one receptacle having enclosed bottom and side surfaces and open tops, said hollow interior of said container body sealed and providing a fluid-tight reservoir to hold a fluid or a frozen or partially frozen fluid or gel, said lower body portion containing a dispenser to permit the controlled release of fluid stored in said interior of said container, wherein said lower body portion includes a sealed cover such that said lower body portion forms said fluid-tight reservoir, and wherein said upper and said lower body portions are releasably secured together to permit the interchangeability of upper body portions having alternate sized and alternately configured receptacles.

2. The cooler as claimed in claim 1 wherein said dispenser is a spigot or a valve.

3. The cooler as claimed in claim 1 wherein said container body includes at least one expansion zones, said expansion zones allowing for the expansion of said container upon the freezing and expansion of water or liquid stored in said hollow interior.

4. The cooler as claimed in claim 1 wherein said upper and said lower body portions are sealed together.

5. A cooler comprising a container body comprised of an upper and a lower body portion, each of said body portions having an exterior surface and at least a partially hollow interior, said upper body portion having at least one receptacle formed within said exterior surface and extending into said hollow interior, said at least one receptacle having enclosed bottom and side surfaces and open tops, said hollow interior of said container body sealed and providing a fluid-tight reservoir to hold a fluid or a frozen or partially frozen fluid or gel, said lower body portion containing a dispenser to permit the controlled release of fluid stored in said interior of said container, and a sealed fluid bladder within said hollow interior of said container body, said bladder connected to said dispenser and receiving and storing fluid introduced into said hollow interior.

6. A cooler comprising a container body formed generally from a first and a second body portion, at least one of said first and second body portions having at least a partially hollow interior and a dispenser, at least one of said body portions having at least one receptacle formed in their exterior surfaces, said at least one receptacle having enclosed bottom and side surfaces and open tops, said at least partially hollow interior providing a fluid-tight reservoir to hold a fluid, said dispenser permitting the controlled release of fluid from said at least partially hollow interior, said first and second body portions releasably securable together such that said at least one receptacle create an enclosed cavity between said body portions to accommodate and receive articles therein for the purpose of helping to maintain said articles at a desired temperature, wherein said first and second body portions are releasably securable together through use of one or more straps or clasps securable to each of said body portions.

7. The cooler as claimed in claim 6 wherein each of said first and second body portions have at least partially hollow interiors providing fluid-tight reservoirs, each of said first and second body portions further each having a dispenser.

8. The cooler as claimed in claim 6 wherein only one of said first and said second body portions has at least a partially hollow interior.

9. The cooler as claimed in claim 6 wherein said first and said second body portions include handles to assist in carrying and transporting said cooler.

10. A cooler comprising a container body formed generally from a first and a second body portion, at least one of said first and second body portions having at least a partially hollow interior and a dispenser, at least one of said body portions having at least one receptacle formed in their exterior surfaces, said at least one receptacle having enclosed bottom and side surfaces and open tops, said at least partially hollow interior providing a fluid-tight reservoir to hold a fluid, said dispenser permitting the controlled release of fluid from said at least partially hollow interior, said first and second body portions releasably securable together such that said at least one receptacle create an enclosed cavity between said body portions to accommodate and receive articles therein for the purpose of helping to maintain said articles at a desired temperature, wherein said first and said second body portions include co-operating members that assist in maintaining said first and second body portions in an aligned configuration when releasably secured together.

11. The cooler as claimed in claim 10 wherein each of said first and second body portions have at least partially hollow interiors providing fluid-tight reservoirs, each of said first and second body portions further each having a dispenser.

12. The cooler as claimed in claim 10 wherein only one of said first and said second body portions has at least a partially hollow interior.

13. The cooler as claimed in claim 10 wherein said first and second body portions are releasably securable together through use of one or more straps or clasps securable to each of said body portions.

14. The cooler as claimed in claim 10 wherein said first and said second body portions include handles to assist in carrying and transporting said cooler.

* * * * *